US010220641B2

(12) United States Patent
Wakamatsu

(10) Patent No.: US 10,220,641 B2
(45) Date of Patent: Mar. 5, 2019

(54) PRINTER AND OPERATION MODE SETTING METHOD FOR PRINTER

(71) Applicant: SATO HOLDINGS KABUSHIKI KAISHA, Tokyo (JP)

(72) Inventor: Kazuhito Wakamatsu, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 143 days.

(21) Appl. No.: 15/127,614

(22) PCT Filed: Jul. 16, 2015

(86) PCT No.: PCT/JP2015/070434
§ 371 (c)(1),
(2) Date: Sep. 20, 2016

(87) PCT Pub. No.: WO2016/021387
PCT Pub. Date: Feb. 11, 2016

(65) Prior Publication Data

US 2018/0170076 A1 Jun. 21, 2018

(30) Foreign Application Priority Data

Aug. 5, 2014 (JP) ..... 2014-159327

(51) Int. Cl.
*B41J 11/70* (2006.01)
*B41J 29/38* (2006.01)
(Continued)

(52) U.S. Cl.
CPC ..... *B41J 11/70* (2013.01); *B41J 2/32* (2013.01); *B41J 3/4075* (2013.01); *B41J 29/38* (2013.01);
(Continued)

(58) Field of Classification Search
CPC .... B41F 16/00; B41J 2/32; B41J 13/00; B41J 13/0009; B41J 15/046; B41J 15/044; B41J 15/04; B41J 15/00; B41J 15/048; B41J 2/325; B41J 3/4075; B41J 15/042; B41J 2202/34; B41J 11/66; B41J 11/663; B41J 11/666; B41J 11/68; B41J 11/70; B41J 11/706; B41M 5/0052; B26D 1/085; B26D 2007/005
See application file for complete search history.

(56) References Cited

U.S. PATENT DOCUMENTS

2010/0030925 A1 2/2010 Inoue

FOREIGN PATENT DOCUMENTS

JP 8-324050 A 12/1996
JP 2004-175443 A 6/2004
(Continued)

OTHER PUBLICATIONS

Chinese Office Action, dated Feb. 8, 2018, 6 pages.

*Primary Examiner* — Kristal Feggins
(74) *Attorney, Agent, or Firm* — Foley & Lardner LLP

(57) ABSTRACT

A printer comprises a linerless label operation mode and a linered label operation mode as operation modes. When a cutter unit is coupled to a coupling portion, a control unit of the printer detects the operation mode of the printer based on whether the cutter unit is a cutter unit configured to cut the linerless label or a cutter unit configured to cut the linered label, and sets the operation mode of the printer to a linerless label operation mode or a linered label operation mode.

11 Claims, 3 Drawing Sheets

(51) Int. Cl.

| | |
|---|---|
| ***B41J 2/32*** | (2006.01) |
| ***B41J 3/407*** | (2006.01) |
| ***B65C 11/02*** | (2006.01) |
| *B26D 7/00* | (2006.01) |
| *B26D 1/08* | (2006.01) |

(52) U.S. Cl.
CPC ..... *B65C 11/021* (2013.01); *B65C 11/0284* (2013.01); *B26D 1/085* (2013.01); *B26D 2007/005* (2013.01)

(56) References Cited

FOREIGN PATENT DOCUMENTS

| | | | |
|---|---|---|---|
| JP | 2005-239334 | A | 9/2005 |
| JP | 2006-341883 | A | 12/2006 |
| JP | 2010-33519 | A | 2/2010 |
| JP | 2010-228209 | A | 10/2010 |
| JP | 2011-156683 | A | 8/2011 |
| JP | 2011-161650 | A | 8/2011 |
| JP | 2014-716 | A | 1/2014 |
| JP | 2014-46484 | A | 3/2014 |
| JP | 2014-104567 | A | 6/2014 |
| JP | 2015-150778 | A | 8/2015 |

PRINTER AND OPERATION MODE SETTING METHOD FOR PRINTER

TECHNICAL FIELD

The present invention relates to a technique to detect and set an operation mode of a printer.

BACKGROUND ART

There has been a printer that prints predetermined information on a print sheet such as a linered label, a linerless label, a tag sheet without an adhesive agent layer, or similar sheet to issue (see JP2010-33519A).

However, when this printer employs a thermal transfer method that uses a thermal transfer ink ribbon, a thermal color-developing method that uses a thermal paper sheet, or similar method as a printing unit, in consideration of a mechanism, materials and similar factor of a thermal head and a platen roller part of the printer, regardless of the type of the print sheet (the linered label, the linerless label, the tag sheet without the adhesive agent layer, or similar sheet), printing by one printer has been achieved.

Furthermore, this type of printer may be coupled to a cutter unit for cutting a printed print sheet by a predetermined pitch in the printing unit. However, various operation modes such as specific specifications in the printing unit for a printing speed, a print density, and similar setting corresponding to the type of the print sheet, a sensor method for a sensor to detect the position of the print sheet, and further, a stop position of the print sheet after cutting in the cutter unit should be changed properly.

That is, depending on the type of the print sheet loaded on the printer, the operation mode of the printer is necessary to be set.

Conventionally, by manually switching a dip switch or similar switch in the printer, the operation mode of the printer is switched.

However, in the case where the type of the print sheet loaded on the printer is changed, or every time when the coupled cutter unit differs, the above-described dip switch should be changed on the printer. Here, there is a problem that this is not only a labor, but also undeniable to occur a switching error.

The present invention has been made in view of the above-described problems, and it is an object of the present invention to provide a printer that is configured to automatically detect an operation mode of the printer corresponding to a cutter unit to which the printer is coupled.

SUMMARY OF INVENTION

An embodiment of the present invention provides a printer having a linerless label operation mode and a linered label operation mode as operation modes. The printer comprises a printing unit that has a thermal head and a platen roller, a coupling portion configured to couple a cutter unit, and a control unit configured to: detect the operation mode of the printer based on whether the cutter unit is a cutter unit configured to cut a linerless label or a cutter unit configured to cut a linered label when the cutter unit is coupled to the coupling portion, and set the operation mode of the printer to the linerless label operation mode or the linered label operation mode based on the detecting result.

The other embodiment provides an operation mode setting method for the corresponding printer.

These embodiments ensure to detect an appropriate operation mode of the printing unit and the cutter unit of the printer by coupling the cutter unit to the printer via a connecting terminal. This eliminates the need for a troublesome operation such as a conventional dip switch operation. Only an easy and simple operation to couple the cutter unit to the printer is enough to change the operation mode of the printer automatically.

DESCRIPTION OF EMBODIMENTS

The embodiment of the present invention includes a mode detecting signal port for detecting the operation mode of the printer as a connecting terminal to couple the cutter unit to the printer in addition to an operation signal port to transmit and receive a signal for operating the cutter unit. This realizes a printer that is configured to prevent operation errors in switching the operation mode of the printer by a simple and easy operation to couple the cutter unit to the printer. The embodiment of the present invention also achieves the printer configured to detect the operation mode of the printer when the cutter unit is coupled to the printer. The embodiment of the present invention also achieves the printer configured to proper collaborate operations with the cutter unit depending on the type of the print sheet loaded on the printer.

Next, a description will be given of the printer according to the embodiment of the present invention with an exemplary thermal printer 1 as the printer based on FIG. 1 to FIG. 4.

Figure 1:
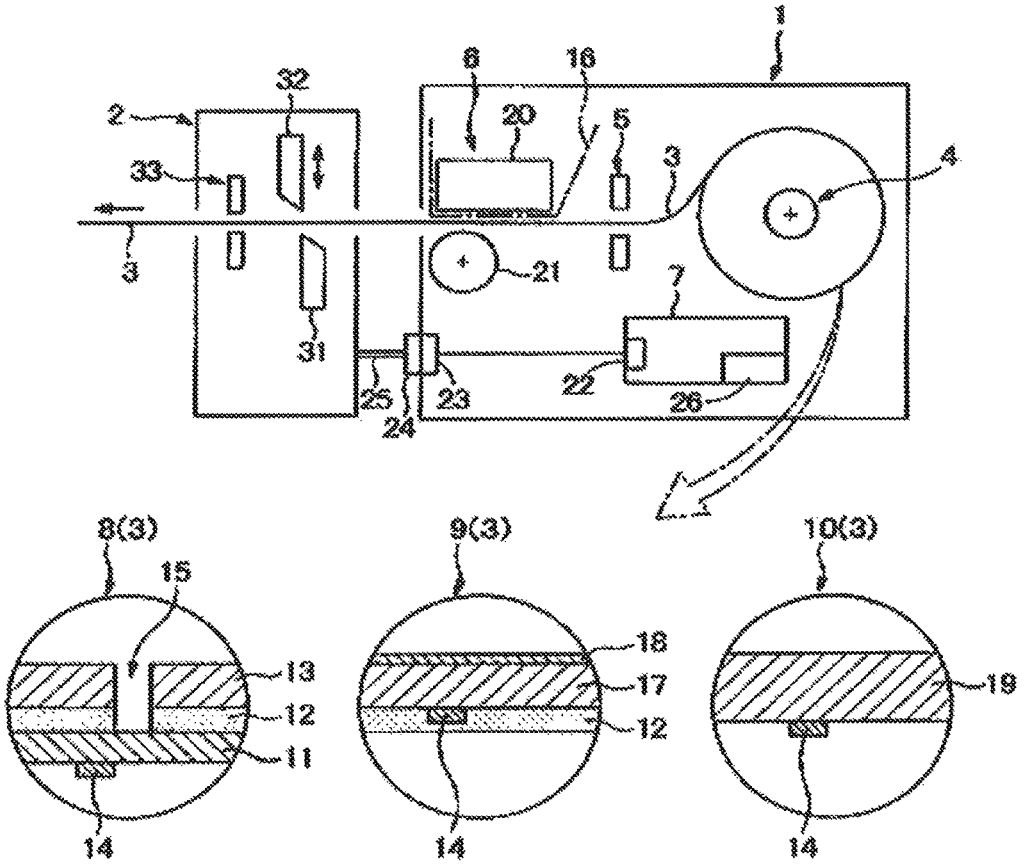
FIG. 1 is a schematic side view illustrating a thermal printer and a cutter unit according to an embodiment of the present invention.

FIG. 1 is a schematic side view illustrating the thermal printer 1 (printer) and a cutter unit 2. The thermal printer 1 includes a supplying unit 4, which supplies print sheets 3, a detecting unit 5, a printing unit 6, and a control unit 7.

The cutter unit 2 includes two types of cutter unit, a cutter unit to cut a linerless label, and a cutter unit to cut a linered label. The cutter unit to cut the linerless label is different from the cutter unit to cut the linered label that has a cutter blade without non-adhesive coating for cutting the linered label in a point where, for example, the cutter unit to cut the linerless label has a cutter blade with non-adhesive coating to prevent paste on the backside surface of the linerless label from adhering on the cutter in cutting the linerless label.

As illustrated in the virtual line circle in FIG. 1 with enlarged cross-sectional surfaces, the print sheet 3 comprises a linered label 8, a linerless label 9, a tag sheet 10 without an adhesive agent layer, or similar type.

The linered label 8 comprises a strip-shaped liner 11, a label piece 13, which temporarily adheres on the liner 11 via an adhesive agent layer 12, and a position detecting mark 14 preliminarily printed on the backside surface of the liner 11.

It should be noted that, for detecting the position, a label gap 15 between the label pieces 13 may be used.

As the label piece 13, a thermal paper sheet with a thermosensitive color-developing agent layer or a paper sheet printable by a thermal transfer ink ribbon 16 (virtual line in FIG. 1) can be used.

The linerless label 9 comprises a thermal label 17 for thermosensitive color-developing that has the adhesive agent layer 12 on the backside surface without the liner 11, a release agent layer 18 that is an upper layer of the thermal label 17, and the position detecting mark 14 preliminarily printed on the backside surface of the thermal label 17.

The tag sheet 10 comprises a tag material 19 composed of the thermal paper sheet that has the thermosensitive color-developing agent layer without the liner 11 and the adhesive agent layer 12, and the position detecting mark 14 preliminarily printed on the backside surface of the tag material 19. As the tag material 19, as well as the linered label 8, a paper sheet printable by the thermal transfer ink ribbon 16 (virtual line in FIG. 1) can be used.

The thermal printer 1 can be loaded the print sheet 3 such as the above-described linered label 8, the linerless label 9, or the tag sheet 10. Corresponding to the configuration (the type) of the print sheet 3, the printing at the appropriate printing speed should be performed in the printing unit 6.

For example, the linerless label 9 is preferably printed at low speed as the printing speed compared with the linered label 8 and the tag sheet 10. Depending on the thickness and the material of each of the label piece 13 (the linered label 8), the thermal label 17 (the linerless label 9), or the tag material 19 (the tag sheet 10), in addition to the printing speed, the print density should be appropriately chosen for each of the printing speeds. For example, in case of the print sheet 3 with thin thickness, the printing speed should be comparatively low, and at the same time, the print density should be comparatively high.

Furthermore, as a position detecting sensor that is used in the detecting unit 5 to detect the relative position of the print sheet 3 with respect to the printing unit 6 and the cutter unit 2, an appropriate type of sensor should be employed. For example, for the linered label 8, any type sensor of a transmission type and a reflection type can be employed because the linered label 8 comprises the position detecting mark 14 or the label gap 15. The linerless label 9 requires a reflection type sensor because the linerless label 9 can preliminarily include only the position detecting mark 14. Similarly, the tag sheet 10 requires a reflection type sensor.

Depending on the type of the print sheet 3, the standby position of the end portion of the print sheet 3 within the standby time after cutting the paper sheet in the cutter unit 2 until the start of the next printing operation differs (described later with reference to FIG. 3 and FIG. 4).

The printing unit 6 comprises a thermal head 20 and a platen roller 21, nipping the print sheet 3 (or the thermal transfer ink ribbon 16 with the print sheet 3) between the thermal head 20 and the platen roller 21 at the predetermined printing pressure. Then, the printing unit 6 rotatably drives the platen roller 21 and supplies printing data with the thermal head 20. This ensures the print sheet 3 to be printable. It should be noted that the platen roller 21 can be rotatably driven in any direction of normal and reverse, and can transport the print sheet 3 in the downstream direction or the upper stream direction as necessary.

The control unit 7 controls each of the above-described detecting unit 5, the printing unit 6, and the cutter unit 2. That is, the control unit 7 is configured to be coupled to the cutter unit 2 via an I/O port 22 and a printer side connecting terminal 23, and further, a unit side connecting terminal 24 of the cutter unit 2 side and a unit cable 25.

Further, the control unit 7 comprises an operation mode memory 26 such as a non-volatile RAM.

The operation mode memory 26 stores pieces of appropriate specification data of respective operation modes of the thermal printer 1 corresponding to the above-described types of the print sheet 3.

That is, corresponding to the type of the print sheet 3, the operation mode memory 26 stores the appropriate printing speed and the print density of the print sheet 3 in the printing unit 6, the appropriate type of the position detecting sensor for the print sheet 3, and further, the appropriate stop position and standby position of the print sheet 3 cut in the cutter unit 2 as operation modes of the thermal printer 1.

Figure 2:
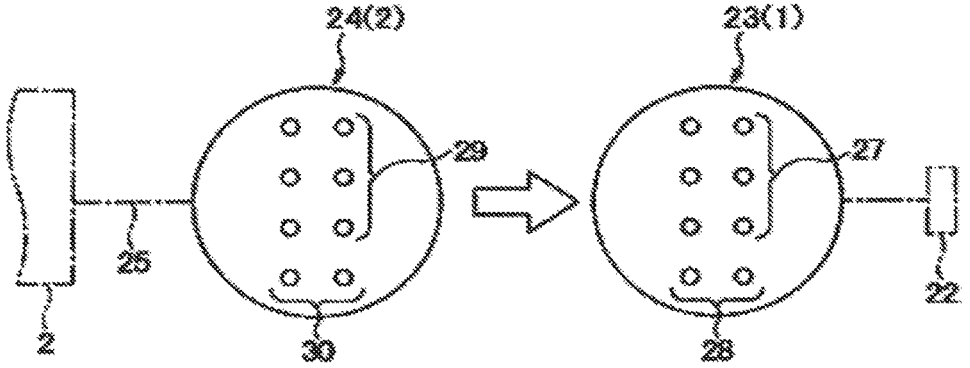
FIG. 2 is a diagram for illustrating a printer side connecting terminal located at the thermal printer side and a unit side connecting terminal located at the cutter unit side.

FIG. 2 is a diagram illustrating the printer side connecting terminal 23 located at the thermal printer 1 side and the unit side connecting terminal 24 located at the cutter unit 2 side. The printer side connecting terminal 23 and the unit side connecting terminal 24 mechanically and electrically couple the thermal printer 1 to the cutter unit 2.

The printer side connecting terminal 23 includes a printer side operation signal port 27, which is disposed six pieces for example, to transmit and receive the signal causing the cutter unit 2 to operate and a printer side mode detecting signal port 28, which is disposed two pieces for example, to detect the operation mode of the thermal printer 1.

The unit side connecting terminal 24 includes a unit side operation signal port 29, six pieces for example, that is coupled to the printer side operation signal port 27 to transmit and receive the signal that causes the cutter unit 2 to operate and a unit side mode detecting signal port 30, two pieces for example, that is coupled to the printer side mode detecting signal port 28 to detect the operation mode of the thermal printer 1.

The connection configuration between the printer side operation signal port 27 and the unit side operation signal port 29, and the connection configuration between the printer side mode detecting signal port 28 and the unit side mode detecting signal port 30 can employ any configuration. For example, a combination configuration of an engaging pin and an engaging hole, attaching and removing configuration by magnetic force, or similar configuration may be employed.

The cutter unit 2 is coupled to the printer side connecting terminal 23 located at the thermal printer 1 via the unit cable 25 and the unit side connecting terminal 24. This ensures the control unit 7 to detect the operation mode of the thermal printer 1 corresponding to the type of the print sheet 3 based on the respective pieces of specification data for each of the operation modes stored in the operation mode memory 26.

That is, one (one set of) or a plurality of (a plurality sets of) printer side mode detecting signal port 28 and unit side mode detecting signal port 30 is or are disposed. A binary code preliminarily set in the mode detecting signal ports 28 and 30 ensures the operation mode of the thermal printer 1 to be detected.

Specifically, via the unit cable 25 and the unit side connecting terminal 24, as the cutter unit 2, the cutter unit to cut the linerless label or the cutter unit to cut the linered label is coupled to the printer side connecting terminal 23 located at the thermal printer 1. At this time, the binary codes different between the cutter unit to cut the linerless label and the cutter unit to cut the linered label is transmitted to the printer side mode detecting signal port 28 located at the printer side connecting terminal 23. This ensures the thermal printer 1 to detect whether the coupled cutter unit 2 is the cutter unit to cut the linerless label or the cutter unit to cut the linered label.

On the basis of the detecting result, the control unit 7 sets the operation mode of the thermal printer 1 in a linerless label operation mode when the cutter unit to cut the linerless label is coupled, or in a linered label operation mode when the cutter unit to cut the linered label is coupled.

The type of the cutter unit 2 may be detected by changing the combination of the engaging pin and the engaging hole in the connection between the printer side mode detecting signal port 28 and the unit side mode detecting signal port 30. One (one set of) or a plurality of (a plurality set of) ports 28 and 30 may be disposed.

In the embodiment illustrated in FIG. 2, two printer side mode detecting signal ports 28 and two unit side mode detecting signal ports 30 are disposed. For example, as operation modes of the thermal printer 1, when the binary code by the mode detecting signal ports 28 and 30 is "10," the operation mode is detected as the case where the print sheet 3 is the linered label 8 (the linered label operation mode). The binary code by the mode detecting signal ports 28 and 30 is "11," the operation mode is detected as the case where the print sheet 3 is the linerless label 9 (the linerless label operation mode). Then, as described above, the printing speed, the print density, the type of the position detecting sensor of the detecting unit 5, and the standby position of the print sheet 3 cut by the cutter unit 2 (described later with reference to FIG. 3 and FIG. 4), which are appropriate to the respective print sheets 3, are switched as necessary.

When the binary code by the printer side mode detecting signal port 28 and the unit side mode detecting signal port 30 is "00" or "01," the type of the print sheet 3 and other operation modes can be detected as necessary. Needless to say, only for the purpose to detect whether the print sheet 3 is the linered label 8 or the linerless label 9, one (one set of) printer side mode detecting signal port 28 and unit side mode detecting signal port 30 is enough to be disposed.

It should be noted that, as the setting method of the binary code, any method may be employed, for example, mechanically setting the engaging pin or the engaging hole of the printer side mode detecting signal port 28 and the unit side mode detecting signal port 30 to "formed" or "unformed," or even if both the engaging pin and the engaging hole are formed, setting "1" or "0" as an electrical signal.

Setting the arbitrary plurality of the printer side mode detecting signal port 28 and the unit side mode detecting signal port 30 ensures the number of the detectable operation mode to be further increased.

The cutter unit 2 comprises a fixed blade 31 and a movable blade 32, and causes the printed print sheet 3 to pass between the fixed blade 31 and the movable blade 32 to cut the print sheet 3 at a predetermined pitch.

Further, the cutter unit 2 comprises a sheet sensor 33 configured to detect the print sheet 3, on which the printing is performed in the printing unit 6, to be transported to the site of the cutter unit 2. As the type of the sheet sensor 33, any of the transmission type and the reflection type may be employed.

In the cutter unit 2, corresponding to the type of the print sheet 3, the standby position until the start of the next printing of the print sheet 3 after cutting the print sheet 3 is different.

Figure 3:
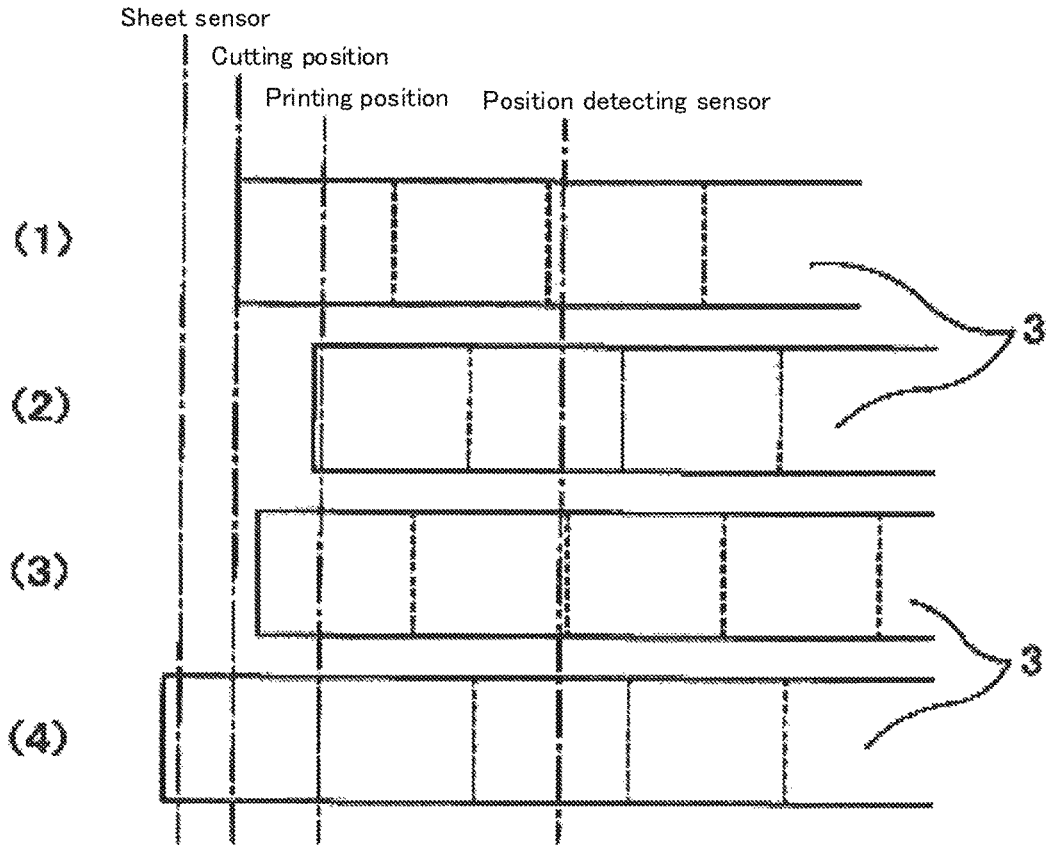
FIG. 3 is a plan view sequentially illustrating a performance of a transport, a printing, and a cutting of a print sheet in a case where the print sheet is a linered label.

FIG. 3 is a plan view sequentially illustrating a performance of a transport, a printing, and a cutting of the print sheet 3 in a case where the print sheet 3 is the linered label 8. FIG. 3 (1) illustrates a state where the print sheet 3, on which the printing is performed in the printing unit 6, is cut in the cutter unit 2. FIG. 3 (2) illustrates a state where the platen roller 21 is reversely rotated, the print sheet 3 is reversely transported in the upstream side to the printing position of the printing unit 6 (the site of the thermal head 20 and the platen roller 21), and the end portion of the print sheet 3 is in printing standby in the printing unit 6. FIG. 3 (3) illustrates a state where the printing is started to the print sheet 3 in printing standby. FIG. 3 (4) illustrates a state where the printed print sheet 3 exceeds the cutting position of the cutter unit 2, and the end portion of the print sheet 3 is transported to the sheet sensor 33.

When the print sheet 3 is the linered label 8, that is, in the case of the linered label operation mode, as described above, reversely transporting the end portion of the linerless label 8 after cutting to the printing unit 6 ensures to start the next printing.

On the linered label 8, the liner 11 is positioned on the backside surface (see enlarged cross-sectional views in FIG. 1). Then, even if the end portion of the linered label 8 is nipped between the thermal head 20 and the platen roller 21 at the predetermined printing pressure until the start of the next printing, the linered label 8 is unlikely to roll up by the platen roller 21 in the start of the printing and the transportation.

Detecting the print sheet 3 (the linered label 8) to be transported to the site of the sheet sensor 33 when the predetermined time has passed after the cutting ensures to detect the linered label 8 not rolling up by the platen roller 21 plased at the printing unit 6, that is, the linered label 8 to be normally transported.

Figure 4:
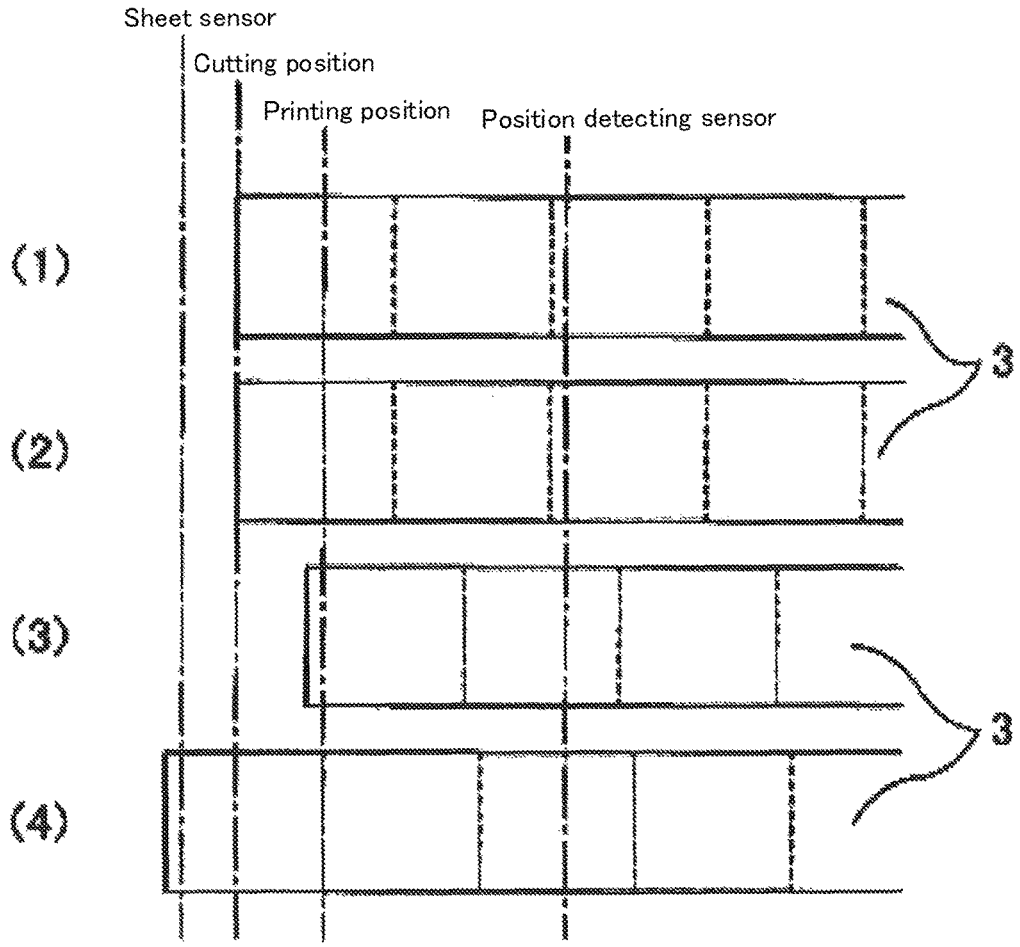
FIG. 4 is a plan view sequentially illustrating a performance of a transport, a printing, and a cutting of a print sheet in a case where the print sheet is a linerless label.

FIG. 4 is a plan view sequentially illustrating a performance of a transport, a printing, and a cutting of the print sheet 3 in a case where the print sheet 3 is the linerless label 9. FIG. 4 (1) illustrates, as well as FIG. 3 (1), a state where the print sheet 3, on which the printing is performed in the printing unit 6, is cut in the cutter unit 2. FIG. 4 (2) illustrates a state where the end portion of the print sheet 3 is in printing standby at the cutting position as it is without reversely transporting the print sheet 3 after cutting in the upstream side to the position of the thermal head 20 located at the printing unit 6 by one pitch. FIG. 4 (3) illustrates a state where, from the printing standby state at the cutting position in the cutter unit 2, the print sheet 3 (the linerless label 9) is reversely transported in the upstream side at the timing of the start of the next printing to cause the end portion of the print sheet 3 to position in the printing unit 6. FIG. 4 (4) illustrates, as well as FIG. 3 (4), a state where the printed print sheet 3 exceeds the cutting position in the cutter unit 2, and the end portion of the print sheet 3 is transported to the sheet sensor 33.

When the print sheet 3 is the linerless label 9, that is, in the case of the linerless label operation mode, as described above, after cutting, the end portion of the linerless label 9 is caused to be wait in the part of the cutter unit 2 without reversely transported to the printing unit 6. This ensures the platen roller 21 to be reversely rotated in the next printing to start the printing with avoiding the linerless label 9 to stick to the platen roller 21.

The linerless label 9 has the exposing adhesive agent layer 12 without the liner 11 on the backside surface of the linerless label 9 (see enlarged cross-sectional views in FIG. 1). Then, if the end portion of the linerless label 9 is nipped between the thermal head 20 and the platen roller 21 at the predetermined printing pressure until the start of the next printing, the linerless label 9 is possibly to roll up by the platen roller 21 in the start of the printing and the transportation.

Accordingly, the thermal printer 1 causes the linerless label 9 to wait until the timing of the start of the next printing in a state where the linerless label 9 is cut in the cutter unit 2 as it is. Then, the thermal printer 1 causes the platen roller 21 to be reversely rotated with the start of next printing. This ensures the transportation control such that the printing is started alter the linerless label 9 is once reversely transported in the upstream side. Then, the possibility of the linerless label 9 to roll up by the platen roller 21 can be reduced.

The printing speed in the case of the linerless label operation mode is preferably slow compared with the printing speed in the case of the linered label operation mode. The reason is as follows: because the linerless label 9 has the release agent layer 18 on the upper layer of the thermal label 17, the thermal label 17 is necessary to be heated enough by the thermal head 20 with considering the thickness. It should be noted that, instead of making the printing speed slow, the setting to make the print density strong may be employed.

As described above, according to the embodiment, only the operation to couple the cutter unit 2 to the thermal printer 1 ensures the operation mode of the thermal printer 1 to be detected. Then, the operability can be improved without a troublesome labor.

The embodiments of the present invention described above are merely illustration of some application examples of the present invention and not of the nature to limit the technical scope of the present invention to the specific constructions of the above embodiments.

This application is based on and claims priority to Japanese Patent Application No. 2014-159327 filed in Japan Patent Office on Aug. 5, 2014, the entire content of which is incorporated herein by reference.

The invention claimed is:

1. A printer comprising:

a printing unit having a thermal head and a platen roller;

a coupling portion configured to couple a cutter unit; and a control unit, wherein the printer is configured to operate in a linerless label operation mode and a linered label operation mode as operation modes, and wherein the control unit is configured to:

detect an operation mode of the printer based on whether the cutter unit is a cutter unit configured to cut a linerless label or a cutter unit configured to cut a linered label when the cutter unit is coupled to the coupling portion, and set the operation mode of the printer to the linerless label operation mode or the linered label operation mode based on a detected result.

2. The printer according to claim 1, wherein between the linerless label operation mode and the linered label operation mode, a standby position of an end portion of the linerless label is different from a standby position of an end portion of the linered label until a start of a next printing operation after cutting by the cutter unit.

3. The printer according to claim 2, wherein in the linerless label operation mode, after the linerless label is cut by the cutter unit, the standby position of the end portion of the linerless label is at a current position thereof, and in the linered label operation mode, after the linered label is cut by the cutter unit, the end portion of the linered label is fed toward the printing unit to the standby position of the end portion of the linered label in the printing unit.

4. The printer according to claim 1, wherein a printing speed is lower in the linerless label operation mode compared with a printing speed in the linered label operation mode.

5. The printer according to claim 1, wherein the coupling portion has a connecting terminal for the cutter unit, the connecting terminal having a mode detecting signal port configured to detect the operation mode.

6. The printer according to claim 5, wherein the mode detecting signal port comprises one mode detecting signal port or a plurality of mode detecting signal ports.

7. The printer according to claim 1, wherein the coupling portion is configured to mechanically couple the printer to the cutter unit.

8. The printer according to claim 7, wherein the coupling portion is further configured to electrically couple the printer to the cutter unit.

9. An operation mode setting method for a printer, comprising:

detecting an operation mode of the printer based on whether a cutter unit is a cutter unit configured to cut a linerless label or a cutter unit configured to cut a linered label when a cutter unit is coupled to a coupling portion of the printer, the printer being configured to operate in a linerless label operation mode and a linered label operation mode; and setting the operation mode of the printer to the linerless label operation mode or the linered label operation mode based on a detecting result.

10. A printer system comprising:

a printer having a linerless label operation mode and a linered label operation mode, the printer comprising a cutter;

a coupler configured to couple to the cutter; and a controller configured to:

detect, when the cutter is coupled to the coupler, an operation mode for the printer based on whether the cutter is configured to cut a linerless label, or the cutter is configured to cut a linered label, and set the operation mode of the printer to the linerless label operation mode or the linered label operation mode based on a detected result.

11. The printer system according to claim 10, wherein the cutter comprises a fixed blade and a movable blade.

* * * * *